United States Patent [19]

Hurley, Jr.

[11] Patent Number: 4,874,283

[45] Date of Patent: Oct. 17, 1989

[54] FRONT DISPENSING TRUCK WITH VERTICALLY AND HORIZONTALLY SWINGABLE SCREW CONVEYOR

[75] Inventor: Irvin H. Hurley, Jr., Wallingford, Conn.

[73] Assignee: Tilcon Tomasso, New Britain, Conn.

[21] Appl. No.: 162,091

[22] Filed: Feb. 29, 1988

[51] Int. Cl.[4] ..... B60P 1/40

[52] U.S. Cl. ..... 414/504; 414/523; 239/675; 239/676; 404/108

[58] Field of Search ..... 414/502, 503, 504, 505, 414/523; 239/672, 674, 675; 198/314, 315, 317, 608, 589; 404/101, 107, 108, 109, 110

[56] References Cited

U.S. PATENT DOCUMENTS

| | | | |
|---|---|---|---|
| 649,609 | 5/1900 | Layman | 414/502 |
| 1,519,249 | 12/1924 | Friedman | 414/502 |
| 2,490,241 | 12/1949 | Smith et al. | 414/502 |
| 2,585,169 | 2/1952 | Potter | 414/505 |
| 2,730,256 | 1/1956 | Louder et al. | 414/505 |
| 2,926,477 | 3/1960 | Bebow | 414/526 |
| 3,089,601 | 5/1963 | Chaney et al. | 414/505 |
| 3,179,272 | 4/1965 | Goldberger | 414/504 |
| 3,341,039 | 9/1967 | Cramage | 414/505 |
| 3,633,879 | 1/1972 | Prichard | 414/505 X |
| 3,857,502 | 12/1974 | Holland et al. | 414/528 |
| 3,907,451 | 9/1975 | Fisher et al. | 404/101 |
| 3,944,098 | 3/1976 | Foote | 414/502 |
| 4,332,505 | 6/1982 | Mauldin | 404/10 |
| 4,350,190 | 9/1982 | McColl | 414/528 |
| 4,390,094 | 6/1983 | Schoeneberger | 414/504 X |
| 4,422,767 | 12/1983 | Yelton | 414/505 X |
| 4,522,341 | 6/1985 | Wall et al. | 239/672 |
| 4,579,479 | 4/1986 | Bryant | 404/107 X |
| 4,781,513 | 11/1988 | Ajögren et al. | 414/505 |

*Primary Examiner*—Robert J. Spar
*Assistant Examiner*—William M. Hienz
*Attorney, Agent, or Firm*—St.Onge Steward Johnston & Reens

[57] ABSTRACT

A front material dispensing and transporting truck is disclosed as comprising a truck having a rear mounted engine operably connected to hydraulic motors which power a conveyor belt and two screw augers which transport material forwardly from a material container to a dispensing opening located in the forward end of a dispensing trough which is mounted in the front of the truck and its cab. Apparatus for vertically and horizontally locating the dispensing opening are provided. The invention allows a single truck operator to easily deliver material to a precise location, by making the dispensing apparatus clearly visible from the truck cab and by providing mechanical delivery of the material from the container to a selected work site.

20 Claims, 4 Drawing Sheets

20
22
24
28
30
32
34
40
42
42
42
46
48
50
50
52
52
5
72
80
84
90
94
96
120
122

32
34
38
42
42
54
54
56
70
72

FRONT DISPENSING TRUCK WITH VERTICALLY AND HORIZONTALLY SWINGABLE SCREW CONVEYOR

DISCLOSURE

FIELD OF THE INVENTION

The present invention relates to a front dispensing truck for use in paving and construction, which allows a precise delivery of construction material to a selected location.

BACKGROUND OF THE INVENTION

The construction of driveways, roadways and other asphalt surfaces is extremely labor intensive. Traditionally, the delivery of asphalt to a construction site has involved: loading a dump truck at a asphalt storage facility, transporting the asphalt to the construction site, dumping the asphalt in a heap, manually filling a wheelbarrow, wheeling the asphalt to a selected location, and dumping the wheelbarrow load at that location.

In some cases, for example, in constructing curbing and driveway aprons in a populated area, there is no convenient location to dump a truckload of asphalt, and the asphalt must be shovelled out of the truck body to the worksite. In such cases, the dump truck often be maneuvered to locate the rear end of the truck adjacent the worksite; in this situation the truck will be positioned perpendicular to the flow of traffic, blocking the roadway and causing traffic tie-ups. The manual filling of wheelbarrows often leads to spillage of the asphalt, which is unsightly, a waste of construction material, and a potential road hazard in that the gravel component of the asphalt may be picked up by the tires of passing vehicles and thrown into the air, where it may impact and fracture the windshields of passing vehicles. Furthermore, such flying asphalt may cause dents in the body and/or mar the paint of passing vehicles.

The traditional dump truck has been improved upon by providing a truck with a storage bin for asphalt that dispenses asphalt from a chute located in the rear of the truck. In this improved design a conveyor located inside the storage bin delivers asphalt to the rearwardly dispensing chute. This general type of rear dispensing design is disclosed for transport of other materials in U.S. Pat. No. 2,490,241 and U.S. Pat. No. 2,585,169. Rearward dispensing truck designs have been found to be unsatisfactory in practice, as they require the operator of the truck to attempt to locate a dispensing trough or chute by maneuvering the truck. Frequently the operator cannot see activities behind the truck because the body of the truck may block the his view. This creates a considerable potential for injury to persons working behind the truck. In addition, since the truck itself must be maneuvered to locate the chute to a particular location, multiple attempts at positioning the truck before unloading are often necessary. Furthermore, similar to the problems related to the use of a dump truck as previously described, the rear dispensing truck must be backed up to a worksite such that the front end of the truck may block traffic.

Therefore, the truck and material handling art discussed above does not disclose a design capable of providing precise and unassisted delivery of a material to a selected location from the front of a truck.

SUMMARY OF THE INVENTION

It is an object of the invention to provide a front discharge material transporting and dispensing truck which allows the precise delivery of material to a selected location. It is a further object of the invention to provide a truck which reduces the manual labor required in delivering construction materials to a work site, and which reduces spillage of such material.

This object, and other objects which will become apparent from the description which follows, are achieved by a truck comprising forward, middle and rear portions, with a engine mounted on the rear portion of the truck. A driver's cab is located in the forward portion of the truck. A container for the material to be transported and dispensed is located in the middle portion of the truck, and has an opening at its forward end. A gate is provided at the compartment opening to regulate material flow. Means for conveying the material is located in the bottom of the container and extends from the rearward to the forward end of the container to move material forwardly to the container opening. Preferably the conveying means is a conveyor flight having a plurality of paddles extending perpendicularly therefrom. A first trough extends forwardly underneath the cab from the forward end of the container, and contains a first screw auger for transporting the material beneath the cab and through the first trough. A second trough extends forwardly from the first trough, and has an opening at its forward end for dispensing the material at a selected site. A second screw auger is contained within the second trough for transporting the material to the dispensing opening. The moving elements, namely the conveying means and the screw augers are powered by the engine. Means for synchronizing the conveying means, first screw auger and second screw auger is provided. Preferably, the synchronizing means comprises a staged start-up of the moving elements in which the second screw auger is started first, the first screw auger is started second, and the conveying means is started last. Means for moving the dispensing opening in the forward end of the second trough is provided to pinpoint the delivery of the material. The means for moving the dispensing opening preferably comprises mounting the second trough on a rotatable plate, providing horizontal and vertical pivot mounts on the rear end of the second trough, and a winch to provide vertical movement to the second trough, and at least one hydraulically operated piston to provide horizontal movement to mounting plate and the second trough.

DETAILED DESCRIPTION OF THE INVENTION

Figure 1:
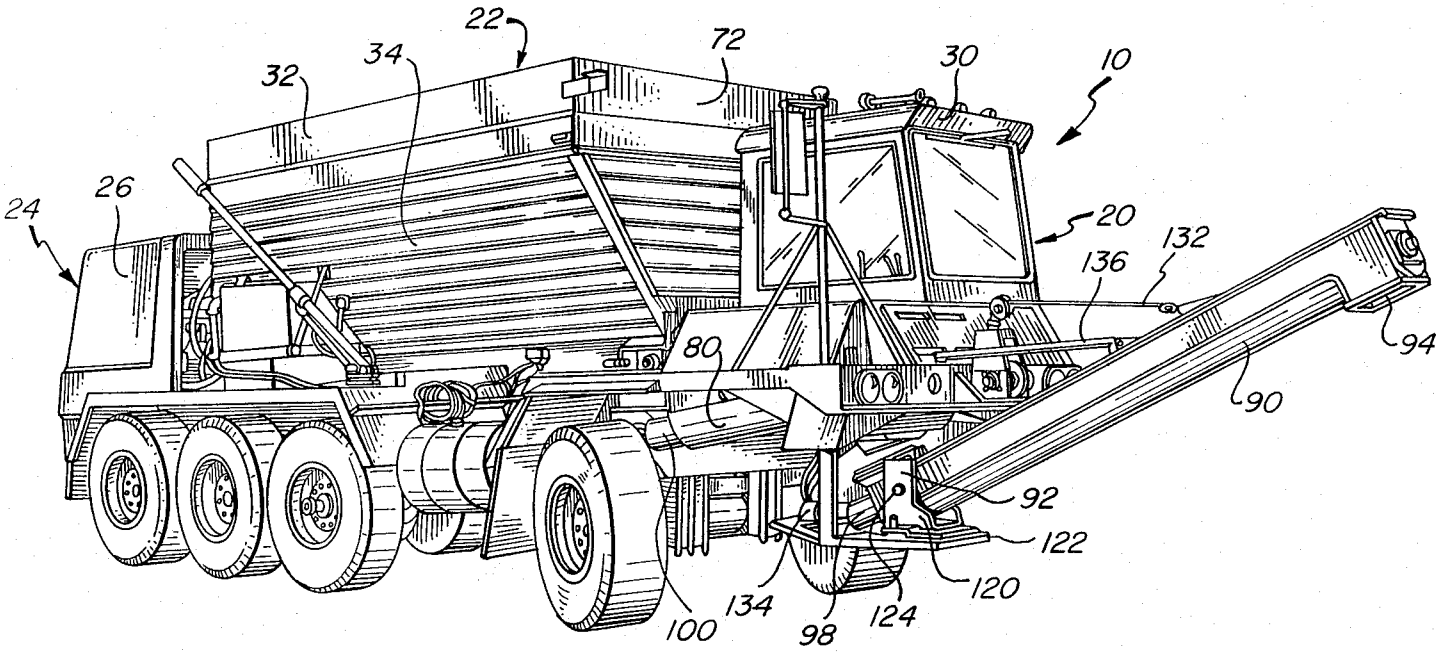
FIG. 1 is a perspective view of an embodiment of the front dispensing truck of the present invention.
Figure 2:
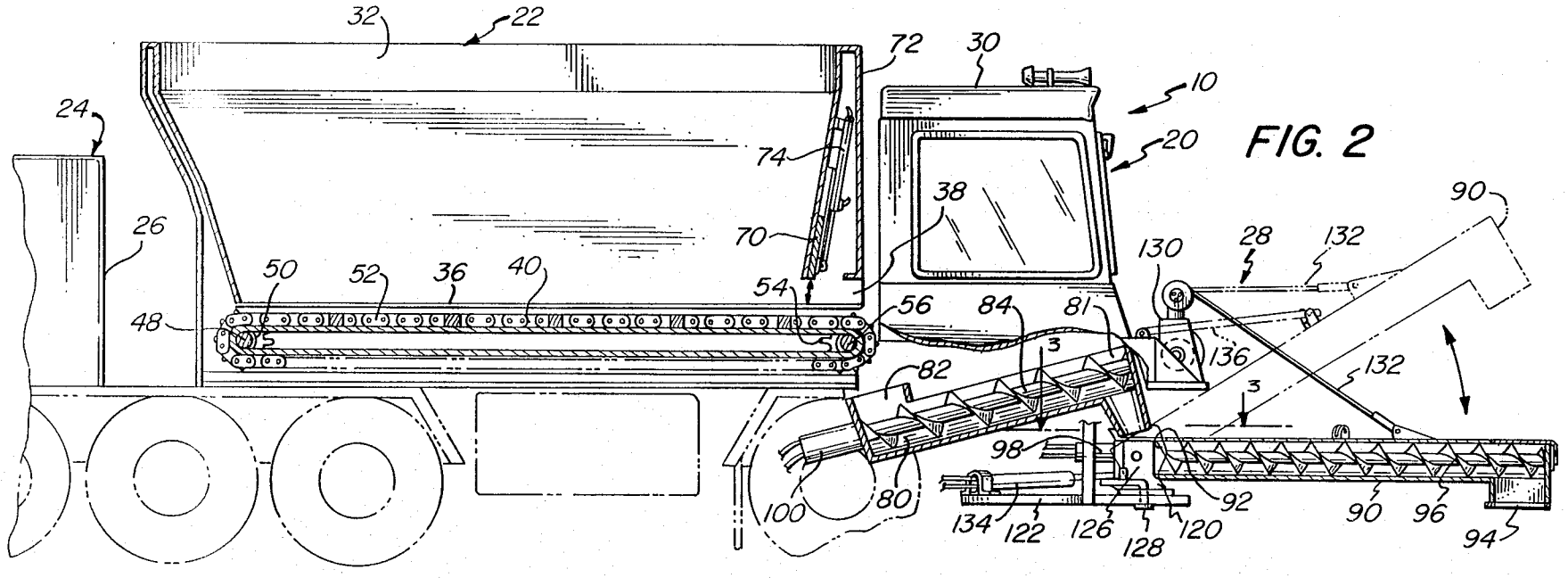
FIG. 2 is a partial cutaway showing a cross-sectional view of an embodiment of the front dispensing truck of the present invention.

With reference to FIGS. 1 and 2, a front dispensing truck 10 is shown. Truck 10 has a forward portion 20, a middle portion 22, and a rear portion 24. Engine 26, which is typically a diesel engine, is mounted in the rear portion 24 of the truck so that the front material dispensing apparatus 28 may be situated in the front portion 20 of the truck. Cab 30 is located in the forward portion 20 of the truck 10 above the front material dispensing apparatus 28. A container 32 for containing the material to be transported and dispensed is located in the middle portion 22 of truck 10.

The walls 34 of container 32 are preferably angled about 52.5 degrees from the horizontal container floor 36. An opening 38 is provided in the forward end of the container 32.

Means for conveying material to the container opening 38 is provided in the bottom of the container adjacent floor 36. The conveying means extends from the rear to the forward end of container 32 and may extend slightly beyond opening 38. Preferably the conveying means comprises a conveyor flight 40 having a plurality of paddles 42 formed from angle irons which are fastened at each end to two endless claims 52 and which extend perpendicularly therefrom. The paddles 42 push the material such as asphalt out of the container 32 and into opening 38.

Figure 4:
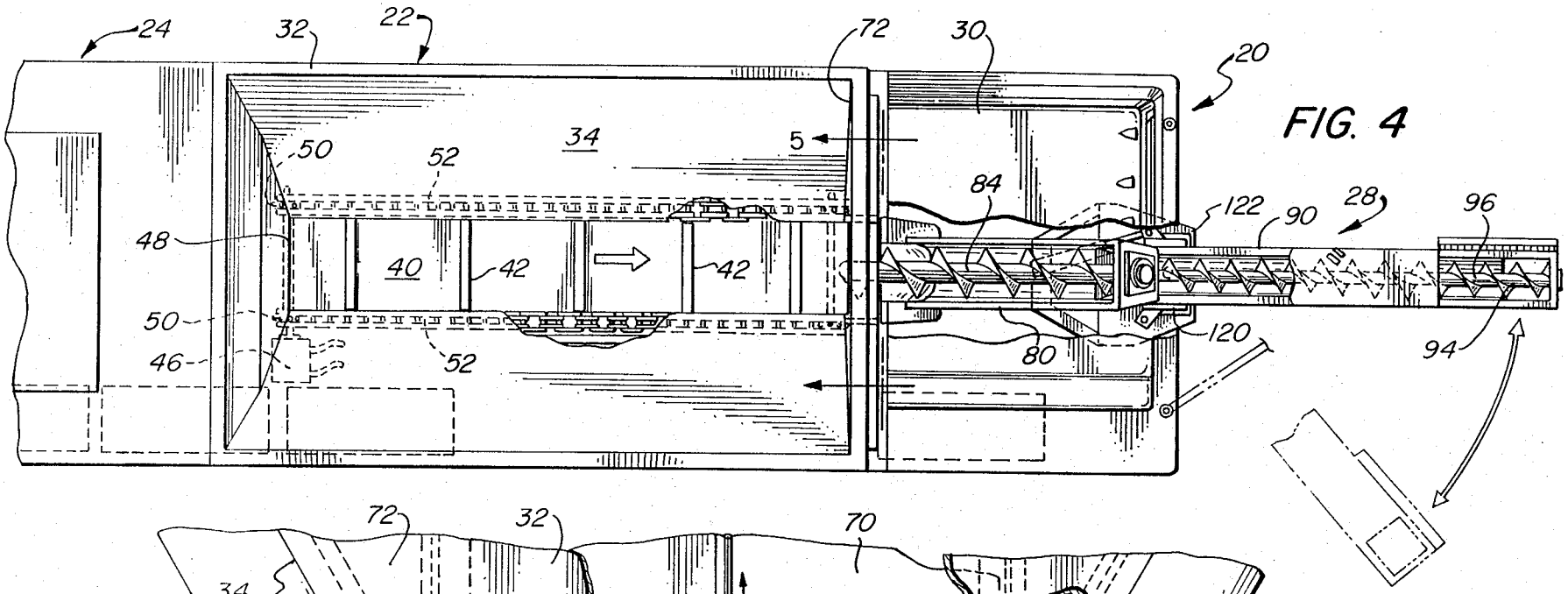
FIG. 4 is a top plan view of an embodiment of the front dispensing truck of the present invention with the cab cut away to show the first and second augers.
Figure 5:
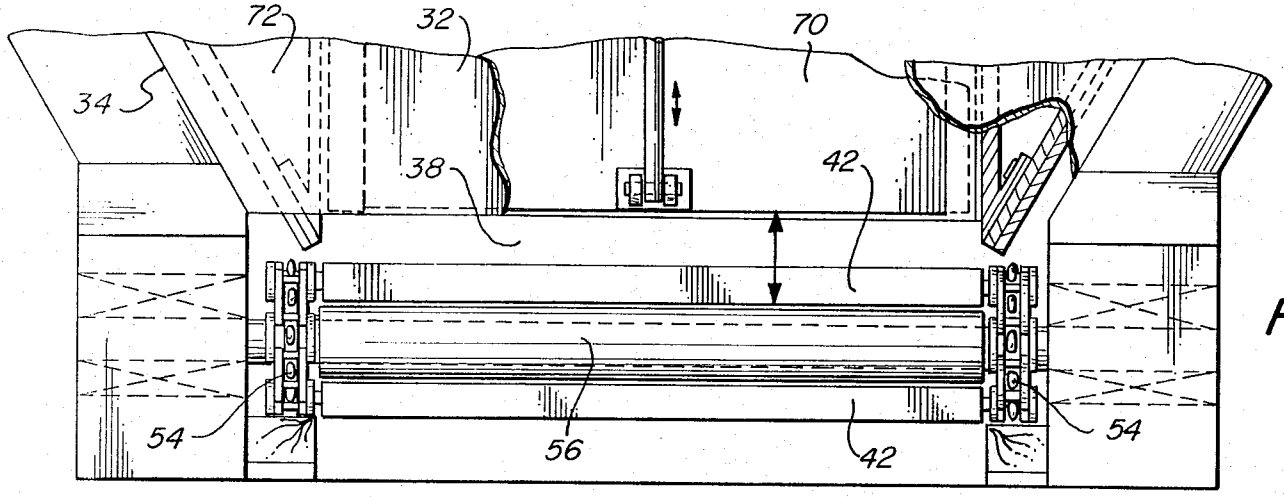
FIG. 5 is a front view of the container taken from the line 5—5 of FIG. 4.

Means for transmitting power from the engine to the conveying means to operate the conveying means is also provided. In the preferred embodiment, the power transmitting means for operating the conveyor flight 40, shown schematically at FIG. 6, comprises a first hydraulic pump 44 operably connected to engine 26 by a driveshaft fitted directly into the crankshaft of engine 26. First hydraulic motor 46 for operating the conveyor belt 40 is operably connected to pump 44 by hydraulic tubing. As shown in FIGS. 4 and 5, a first rotatable spindle 48 is located in the rear portion of container 32 and is operably connected to the hydraulic motor 46. Spindle 48 has a cogwheel 50 at each end, onto which are fitted the endless chains 52 of conveyor flight 40 which extend forwardly to the cogwheels 54 of another rotatable spindle 56 located in the forward end of container 32. The rotation provided to spindle 48 by hydraulic motor 46 is transmitted by the chains 52 to the spindle 56, such that both spindles rotate, and causes the flight 40 to move material forwardly to opening 38.

The hydraulic circuit 57 transmitting hydraulic fluid from pump 44 to motor 46 comprises a pressure line 58 connected at its upstream end to pump 44 and at its downstream end to hydraulic motor 46; a hydraulic fluid reservoir 60; a relief line 62 connecting the hydraulic motor 46 and reservoir 60; a filter 64 located in the relief line 62 downstream of hydraulic motor 46 adjacent reservoir 60; a flow control valve 66 located in the pressure line 58 and connected to relief line 62 for controlling the hydraulic fluid flow from hydraulic pump 44 to said hydraulic motor 46; and a suction line 68 connecting reservoir 60 to hydraulic pump 44.

A gate 70 may be provided in opening 38 to regulate the flow of material out of the container 32. Preferably gate 70 is mounted in wall 72 of container 32 and is a sliding gate which is hydraulically actuated. Typically the hydraulic actuator 74 is connected by hydraulic tubing to an electric pump 76 which is powered by the truck's electrical system.

A first trough 80, which may be a chute, tube or other shape suitable for transporting material, is mounted beneath cab 30 and extends forwardly from the forward end of the container 32. First trough 80 is angled upwardly from its rear to its forward end 81 at about 15 degrees. First trough 80 has an opening 82 at its rearward end adjacent and below container opening 38 to receive material ejected from opening 38 by the action of conveyor flight 40. A first screw auger 84 is disposed within and substantially coaxial with first trough 80, and serves to transport material through the first trough 80 beneath cab 30. In the preferred embodiment, first screw auger 84 has a diameter of twelve inches.

A second trough 90 extends forwardly from a point adjacent and below the forward end of first trough 80. Second trough 90 has an opening 92 adjacent and below the forward end 81 of first trough 80 for receiving the material transported through first trough 80. Second trough 90 has a dispensing opening 94 at its forward end for delivery of material to a selected location. A second screw auger 96 is disposed within and substantially coaxial with second trough 90 to transport material through second trough 90. Preferably, second screw auger 96 has a diameter of nine inches.

Means for transmitting power from the engine to the screw augers 84 and 96 is provided. In the preferred embodiment, shown schematically at FIG. 6, second and first screw augers 96 and 84 are powered by second and third screw auger hydraulic motors 98 and 100 respectively. Hydraulic motors 98 and 100 are in turn powered by second hydraulic pump 102 which is operably connected to engine 26. In the preferred embodiment, hydraulic pump 44 for operating the conveyor belt 40 and hydraulic pump 102 for operating the screw augers 84 and 96 are piggybacked and are driven by a single driveshaft extending from the crankshaft of engine 26. In the preferred embodiment, pump 44 has a 35 gallons per minute capacity, and pump 102 has a 28 gallons per minute capacity.

Figure 6:
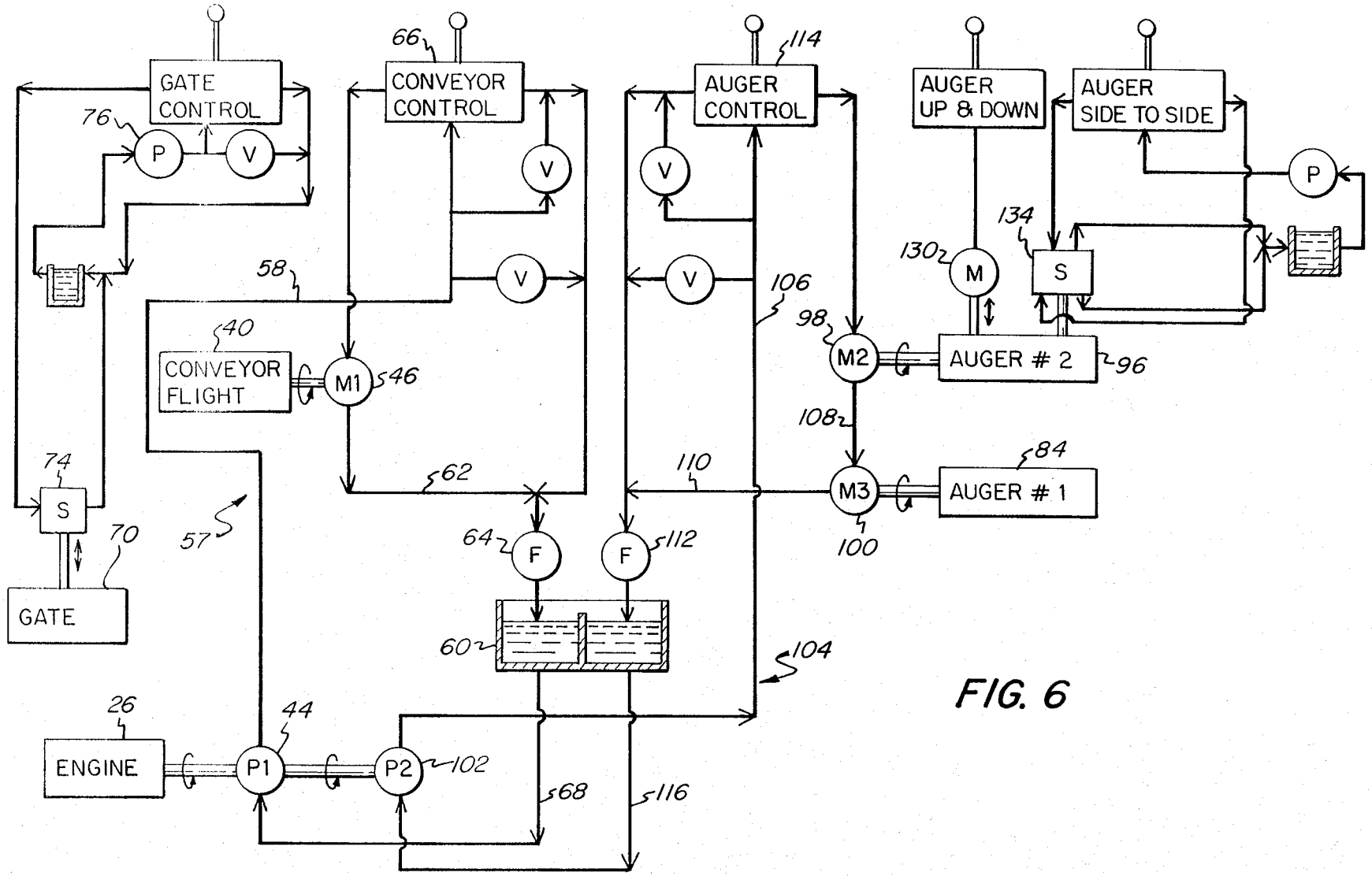
FIG. 6 is a schematic drawing of the hydraulic systems of an embodiment of the front dispensing truck of the present invention.

Hydraulic circuit 104 for transmitting hydraulic fluid from pump 102 to motors 98 and 100 for operating the screw augers 96 and 84 is shown in FIG. 6. The serial connection of hydraulic pump 102 to second hydraulic motor 98 and then to third hydraulic motor 100 provides a means for synchronizing the first and second screw augers 84 and 96 such that the second screw auger 96 begins operating before first screw auger 84, minimizing or eliminating problems of jamming and blockage of the second trough 90 which can occur if a large load of material is dumped into second trough 90 before screw auger 96 begins turning. The optimal start-up of the material transporting elements of the truck is achieved by first activating the screw auger hydraulic motors 98 and 100 in hydraulic circuit 104, followed by activation of the conveyor belt hydraulic motor 46 in hydraulic circuit 47.

Hydraulic circuit 104 thus comprises a first pressure line 106 connected at its upstream end to hydraulic pump 102 and at its downstream end to the second hydraulic motor 98; a second pressure line 108 connected at its upstream end to second hydraulic motor 98 and at its downstream end to third hydraulic motor 100; hydraulic fluid reservoir 60; a relief line 110 connecting the third hydraulic motor 100 at its downstream end to reservoir 60; a filter 112 located in relief line 110 adjacent reservoir 60; a flow control valve 114 located in the first pressure line 106 upstream of the second hydraulic motor 98 and connected to relief line 110 for controlling the hydraulic fluid flow from hydraulic pump 102 to hydraulic motors 98 and 100; and a suction line 116 connecting reservoir 60 to hydraulic pump 102.

Means for moving the dispensing opening 94 of second trough 90 is provided so that the truck operator may locate and hold the dispensing opening 94 at a precise location to deliver material to that location. Separate means for vertically and horizontally moving the dispensing opening 94 may be provided.

Figure 3:
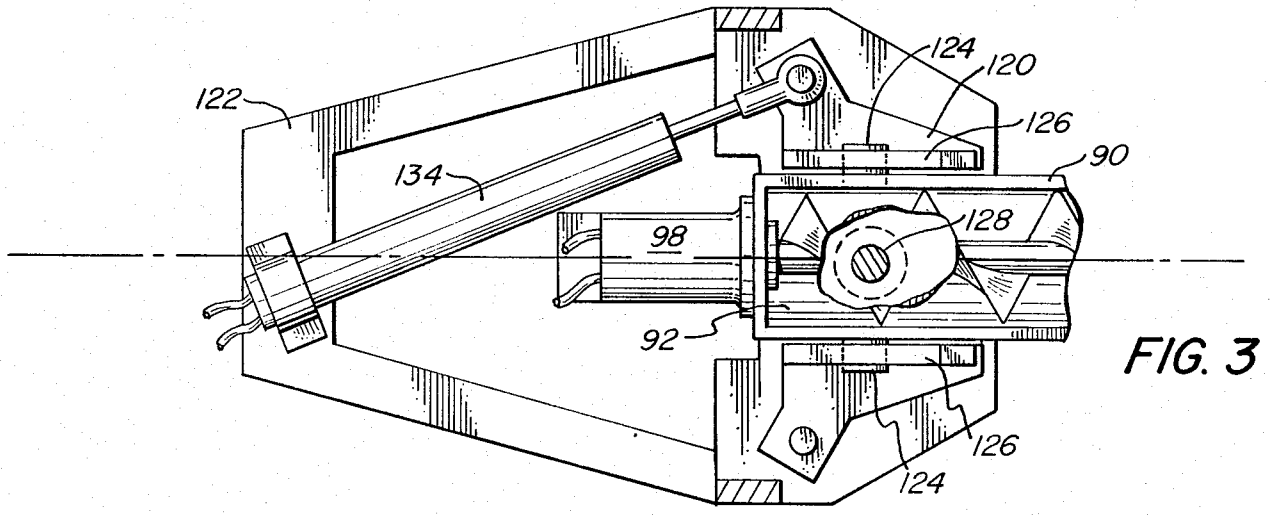
FIG. 3 is a top plan view of the mounting plate and the second trough and second auger in an embodiment of the front dispensing truck of the present invention.

In the preferred embodiment, as shown in FIGS. 2 and 3, the rear end 92 of second trough 90 is pivotally mounted in a U-shaped mounting plate 120 which is pivotally mounted on a platform 122 secured to the truck frame beneath the cab 30. Two substantially horizontal pivot pins 124 extend inwardly from the vertical segments 126 of the U-shaped mounting plate 120 and fit into the sides of the rear end 92 of trough 90, allowing vertical movement of the trough 90. A vertical pivot pin 128 extends upwardly from platform 122 and fits into the base of the U-shaped mounting plate 120, allowing horizontal movement of the U-shaped mounting plate 120 and the trough 90 mounted therein.

Vertical movement of the second trough 90 is effected by a winch 130 connected by cable 132 to the second trough 90. Winch 130 may be either electrically powered or hydraulically powered. If an electric motor is provided to power winch 130, it may be energized by the electrical system of the truck. If a hydraulic motor is provided, is may be powered by a hydraulic circuit including an electrically powered hydraulic pump and associated hydraulic controls. The range of vertical movement of trough 90 is shown in FIG. 2.

Horizontal movement of the second trough 90 is effected by the operation of a hydraulic piston 134, which is secured at one of its ends to platform 122 and at the other end to the U-shaped mounting plate 120. There may be two such pistons to provide horizontal force in both directions, or a single reversing piston may be employed. Hydraulic piston 134 may be operated by connection to the power steering system of the truck. Such a connection poses no safety hazards since the movement and location of the dispensing opening 94 will only be required while the truck is at rest, when no steering power is needed.

A rigid bar 136 may be provided to secure the trough 90 to the front portion 20 of the truck 10 to hold trough 90 in an elevated position during roadway driving.

Therefore, as apparent from the foregoing description, the present invention provides a front dispensing truck which can deliver material precisely to a construction site without the multiple labor-intensive unloading steps characterized by prior art equipment and procedures.

I claim:

1. A front discharge material transporting and dispensing truck, comprising:

a truck comprising a frame having a forward portion and a rear portion, and a middle portion therebetween;

an engine mounted on the rear portion of the truck;

a cab located in the forward portion of said truck;

a container for the material to be transported and dispensed located in the middle portion of said truck, said container having an opening at its forward end;

means for conveying material located in the bottom of said container and extending from the rear to the forward end of said container for moving material forwardly to said container opening;

a first trough extending forwardly underneath said cab from the forward end of said container, the rearward end of said first trough having an opening adjacent said container opening for receiving material from said container;

a first screw auger disposed within said first trough for transporting said material beneath said cab and through said first trough;

a second trough extending forwardly from a point adjacent the forward end of said first trough, said second trough having an opening at its rearward end for receiving material from the forward end of said first trough, and having an opening at its forward end for dispensing said material;

a second screw auger disposed within said second trough for transporting said material through said second trough;

a platform rigidly connected to the frame of the forward end of said truck underneath said cab;

a mounting plate adapted to receive and partially surround the rearward end of said second trough, said mounting plate being mounted on said platform;

a pivot mounting securing said second trough to said surrounding portions of said mounting plate;

a pivot mounting securing said mounting plate to said platform said two pivot mountings permitting said second trough a range of horizontal and vertical movement such that said dispensing opening may be located at a selected point adjacent the ground within the range of spacial movement provided by said pivot mountings;

said second trough being vertically swingable relative to said surrounding portions;

said rearward end of said second trough lying underneath said truck;

means for transmitting power from said engine to said conveying means to operate said conveying means;

means for transmitting power from said engine to said first and second screw augers to operate said first and second screw augers;

means for synchronizing said first screw auger and second screw auger such that the operation of said second screw auger begins before the operation of said first screw auger;

hydraulically activated means for moving said dispensing opening in the forward end of said second trough operably connected to said second trough and providing a sufficient force within a substantial portion of the range of movement of said trough to direct and locate said dispensing opening at a selected point adjacent the ground to deliver material thereto;

means for vertically swinging the end portions of said second trough.

2. A front discharge material transporting and dispensing truck in accordance with claim 1, wherein said conveying means comprises a conveyor flight comprising a plurality of paddles extending perpendicularly from two endless chains.

3. A front discharge material transporting and dispensing truck in accordance with claim 2, wherein said power transmitting means for operating said conveyor belt comprises:

a hydraulic pump operably connected to said engine;

a conveyor flight hydraulic motor operably connected to said pump;

a first rotatable spindle connected to said hydraulic motor, said spindle having a cogwheel at each end thereof;

a second rotatable spindle and having a cogwheel at each end thereof; and each said endless chain being adapted to mount on and engage said cogwheels on each end of said first and second spindles.

4. A front discharge material transporting and dispensing truck in accordance with claim 3, wherein said power transmitting means for operating said conveyor belt further comprises:

a pressure line connected at its upstream end to said hydraulic pump and at its downstream end to said conveyor belt hydraulic motor;

a hydraulic fluid reservoir;

a relief line connecting said hydraulic motor and said reservoir;

a filter located in said relief line downstream of said hydraulic motor adjacent said reservoir;

a flow control valve located in said pressure line and connected to said relief line for controlling the hydraulic fluid flow from said hydraulic pump to said hydraulic motor; and a suction line connecting said reservoir to said hydraulic pump.

5. A front discharge material transporting and dispensing truck in accordance with claim 1, wherein said power transmitting means for operating said first and second screw augers comprises:

a screw auger hydraulic pump operably connected to said engine;

a first hydraulic motor operably connected to said pump and connected to said second screw auger for rotation thereof; and a second hydraulic motor operably connected to said pump and connected to said first screw auger for rotation thereof.

6. A front discharge material transporting and dispensing truck in accordance with claim 5, wherein said power transmitting means for operating said first and second screw augers further comprises:

a first pressure line connected at its upstream end to said screw auger hydraulic pump and at its downstream end to said first hydraulic motor;

a second pressure line connected at its upstream end to said first hydraulic motor and at its downstream end to said second hydraulic motor;

a hydraulic fluid reservoir;

a relief line connecting said second hydraulic motor at the downstream end thereof to said reservoir;

a filter located in said relief line adjacent said reservoir;

a flow control valve located in said first pressure line upstream of said first hydraulic motor and connected to said relief line for controlling the hydraulic fluid flow from said hydraulic pump to said hydraulic motors; and a suction line connecting said reservoir to said hydraulic pump.

7. A front discharge material transporting and dispensing truck in accordance with claim 5, wherein said means for synchronizing said first and second screw augers comprises:

serially connecting said hydraulic pump to said first hydraulic motor, and said first hydraulic motor to said second hydraulic motor.

8. A front discharge material transporting and dispensing truck in accordance with claim 1, wherein:

said mounting plate is generally U-shaped having two vertical segments, and is located at the forward portion of said truck underneath said cab, and has at least one substantially horizontal pivot pin for securing said second trough at its rear end to said vertical segments of said mounting plate;

a winch having a motor and a cable is mounted on the forward end of said truck and said cable is secured to said second trough; and means for providing power to and operably connected to said winch motor.

9. A front discharge material transporting and dispensing truck in accordance with claim 8, wherein said truck further comprises a frame, and wherein said means for horizontally moving said second trough and screw auger comprises:

a platform secured to the frame of said truck under said cab; and wherein said U-shaped mounting plate is rotatably mounted on said platform; and at least one hydraulically operated piston mounted on said platform and secured to said U-shaped mounting plate to rotate said mounting plate.

10. A front discharge material transporting and dispensing truck in accordance with claim 9, wherein said truck further comprises a power steering system and wherein said at least one hydraulically operated piston is operably connected to said power steering system.

11. A front discharge material transporting and dispensing truck in accordance with claim 1, wherein said first screw auger comprises a twelve inch diameter screw.

12. A front discharge material transporting and dispensing truck in accordance with claim 1, wherein said second screw auger comprises a nine inch diameter screw.

13. A front discharge material transporting and dispensing truck in accordance with claim 1, further comprising a gate located at said container opening for controlling the flow of material.

14. A front discharge material transporting and dispensing truck in accordance with claim 8, further comprising a rigid bar secured at one end to the forward end of said truck and at its other end to said second trough, whereby said second trough may be held in an elevated position during roadway driving.

15. A front discharge material transporting and dispensing truck, comprising:

a truck comprising a frame, and having a forward portion and a rear portion, and a middle portion therebetween;

an engine mounted in the rear portion of the truck;

a cab located in the forward portion of said truck;

a container for the material to be transported and dispensed located in the middle portion of said truck, said container having an opening at its forward end;

a gate located at said container opening;

a conveyor flight located in the bottom of said container and extending from the rear to the forward end of said container for moving material forwardly to said container opening, said conveyor flight comprising a plurality of paddles extending perpendicularly from two endless chains;

a first trough extending forwardly underneath said cab from the forward end of said container, the rearward end of said first trough having an opening adjacent said container opening for receiving material from said container;

a first screw auger disposed within said first trough for transporting said material beneath said cab and through said first trough;

a second trough extending forwardly from a point adjacent the forward end of said first trough, said second trough having an opening at its rearward end for receiving material from the forward end of said first trough, and having an opening at its forward end for delivering said material;

a second screw auger disposed within said second trough for transporting said material through said second trough;

a platform rigidly connected to the frame of said truck under said cab;

a U-shaped mounting plate having two vertical segments, said mounting plate being rotatably mounted on said platform;

at least one substantially horizontal pivot pin for securing said second trough at its rear end to said vertical segments of said mounting plate;

a winch having motor and a cable, said winch being mounted on the forward end of said truck and said cable being secured to said second trough; and means for providing power to said winch motor;

at least one hydraulically operated piston mounted on said platform and secured to said U-shaped mounting plate for rotating said mounting plate;

a first hydraulic pump operably connected to said engine;

a first hydraulic motor operably connected to said first hydraulic pump;

a first rotatable spindle connected to said first hydraulic motor, said spindle having a cogwheel at each end thereof;

a second rotatable spindle having a cogwheel at each end thereof;

each said endless chain of said conveyor flight being adapted to mount on and engage the cogwheels of said first and second spindles;

a second hydraulic pump operably connected to said engine;

a second hydraulic motor connected to and downstream of said second hydraulic pump, and connected to said second screw auger for rotation thereof;

a third hydraulic motor connected to and downstream of said second hydraulic motor, and connected to said first screw auger for rotation thereof.

16. A front discharge material transporting and dispensing truck in accordance with claim 15, further comprising:

a first pressure line connected at its upstream end to said second hydraulic pump and at its downstream end to said second hydraulic motor;

a second pressure line connected at its upstream end to said second hydraulic motor and at its downstream end to said third hydraulic motor;

a hydraulic fluid reservoir;

a relief line connecting said third hydraulic motor at the downstream end thereof to said reservoir;

a filter located in said relief line down stream of said third hydraulic motor;

a flow control valve located in said first pressure line upstream of said second hydraulic motor and connected to said relief line for controlling the hydraulic fluid flow from said second hydraulic pump to said second and third hydraulic motors; and a suction line connecting said reservoir to said second hydraulic pump.

17. A front discharge material transporting and dispensing truck in accordance with claim 15, further comprising:

a pressure line connected at its upstream end to said first hydraulic pump and at its downstream end to said first hydraulic motor;

a hydraulic fluid reservoir;

a relief line connecting said first hydraulic motor and said reservoir;

a filter located in said relief line downstream of said first hydraulic motor;

a flow control valve located in said pressure line and connected to said relief line for controlling the hydraulic fluid flow from said first hydraulic pump to said first hydraulic motor; and a suction line connecting said reservoir to said first hydraulic pump.

18. A front discharge material transporting and dispensing truck in accordance with claim 15, wherein said truck further comprises a power steering system and wherein said at least one hydraulically operated piston is operably connected to said power steering system.

19. A front discharge material transporting and dispensing truck in accordance with claim 15, wherein said first screw auger comprises a twelve inch diameter screw.

20. A front discharge material transporting and dispensing truck in accordance with claim 15, wherein said second screw auger comprises a nine inch diameter screw.

* * * * *